United States Patent [19]

Sutherland

[11] Patent Number: 5,065,743

[45] Date of Patent: Nov. 19, 1991

[54] KNEADER

[76] Inventor: W. Don Sutherland, R.R. #2, Glenbow Road, Cochrane, Alberta, T0L 0W0, Canada

[21] Appl. No.: 516,986

[22] Filed: Apr. 30, 1990

Related U.S. Application Data

[63] Continuation-in-part of Ser. No. 208,944, Jun. 20, 1988, Pat. No. 4,920,957.

[51] Int. Cl.[5] ..... A61H 7/00

[52] U.S. Cl. ..... 128/60; 128/52; 128/59; 128/61; 74/425; 74/50

[58] Field of Search ..... 128/24.2, 44, 51, 52, 128/56, 57, 59, 60, 61, 46, 49; 74/425, 50

[56] References Cited

U.S. PATENT DOCUMENTS

| | | | |
|---|---|---|---|
| 1,391,919 | 9/1921 | Thompson | 128/59 |
| 1,577,751 | 3/1926 | Paschall | 128/51 |
| 1,612,899 | 1/1927 | Ahlgren | 128/59 |
| 1,709,170 | 4/1924 | Hassler | 128/52 |
| 2,038,846 | 4/1936 | Matson | 128/67 |
| 2,232,493 | 2/1941 | Stuckey et al. | 128/61 |
| 2,706,980 | 3/1955 | Kahn | 128/59 |
| 3,499,439 | 3/1970 | Boller | 128/49 |
| 3,517,235 | 6/1970 | Flowers et al. | 74/50 |
| 3,592,188 | 7/1971 | Barnett | 128/62 A |
| 3,845,758 | 11/1974 | Anderson | 128/49 X |
| 3,993,052 | 11/1976 | Miyahara | 128/46 |
| 4,404,965 | 9/1983 | Waits et al. | 128/46 |
| 4,633,857 | 1/1987 | Czeczerski | 128/53 X |
| 4,777,940 | 10/1988 | Yamasaki | 128/46 |
| 4,777,945 | 10/1988 | Curtaz et al. | 128/52 |
| 4,936,292 | 6/1990 | Hidetsugu | 128/53 |

*Primary Examiner*—Robert A. Hafer
*Assistant Examiner*—Brian E. Hanlon
*Attorney, Agent, or Firm*—Shlesinger, Arkwright & Garvey

[57] ABSTRACT

A massage device that simulates the action of the human fingers when applied to the head or body. A compact and portable appliance with a kneading mechanism, powered by a small electric motor. The motor is mounted horizontally and has twin shafts that extend beyond the ends of the motor. Gears are attached to both shafts, which are connected to an impart reciprocating motion to a pair of massage fingers. The speed of the motor may be varied by the switch. The kneading action is produced by bunching and releasing of the skin through reciprocating fingers powered by the motor.

13 Claims, 6 Drawing Sheets

KNEADER

This application is a continuation-in-part of U.S. patent application Ser. No. 07/208,944 filed June 20, 1988 now U.S. Pat. No. 4,920,957 issued 5/1/90.

The disclosed invention relates to a massage device that simulates the action of human fingers to provide a deep massaging action.

BACKGROUND OF THE INVENTION

A kneading action is produced by bunching and releasing of the skin, producing and releasing a ridge of bunched skin and can be effected through manual massage, using the hands and fingers to produce the effect. Kneading of the skin is conducive to the release of tension and is beneficial to maintaining a healthy scalp and skin. The electrically operated kneader disclosed herein provides a deep massaging action for general relief of muscular aches, sprains, etc.

Many devices have been produced to bring about the desired effects of a massage. Prior art devices include vibrating, rotary and thumping mechanisms for body massage.

However, the prior art devices have not produced the kneading action provided by this invention, which brings relaxation and enjoyment.

One prior art device, U.S. Pat. No. 2,706,980 to Kahn discloses a scalp massage implement having one set of stationary fingers and one set of reciprocating fingers. However, Kahn does not disclose a self-contained power source or a variable speed operation or the low profile configuration which allows easy application of pressure while the device is in use thus reducing hand and arm fatigue.

In view of the above, it can be seen that there is a need for a device which provides an effective kneading action and forms a hand-held, self-contained unit.

BRIEF SUMMARY OF THE INVENTION

Accordingly, the principle object of this invention is to provide a device which can be hand held and has a low profile configuration to allow pressure to be applied through the palm of the hand of the operator.

Another object of the invention is to provide a gear system orientation which allows a low profile shape of the outside casing which promotes effective use of the kneader.

Yet another object of the invention is to provide a kneader having fingers which reciprocate relative to each other to provide an invigorating massage.

In summary, therefore, this invention is directed to a massage device that simulates the action of the human fingers when applied to the head or body. The disclosed device is a compact and portable appliance with a kneading mechanism, powered by a small electric motor which is energized by rechargeable batteries. The motor is mounted horizontally and has twin shafts that extend beyond ends of the motor. Gears are attached to both shafts which are connected to and impart reciprocating motion to a pair of massage means. Variation in the speed of the motor is achieved by an electronic switch or by a mechanical switch. These and other features and advantages of the invention will be readily apparent in view of the following description and drawings of the above-described invention.

BRIEF DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE PREFERRED EMBODIMENT(S)

Figure 1:
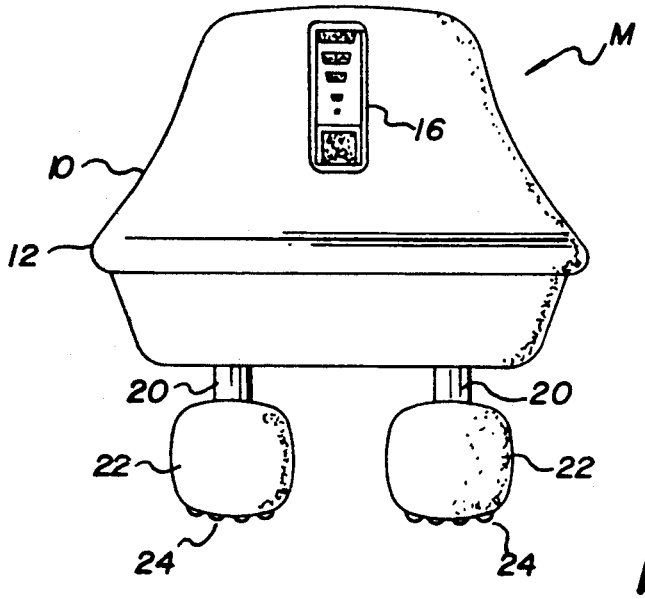
FIG. 1 is an elevational view of the casing of the kneading device showing the variable speed switch and the kneading fingers.
Figure 2:
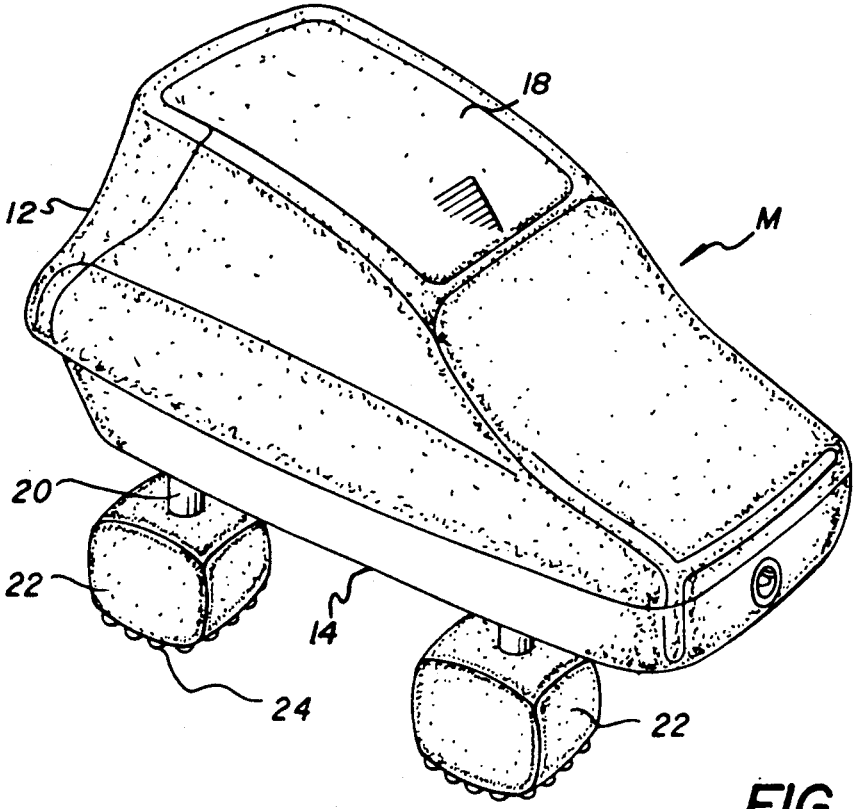
FIG. 2 is a perspective view of the kneading device showing the charging jack and the contour of the casing.
Figure 4:
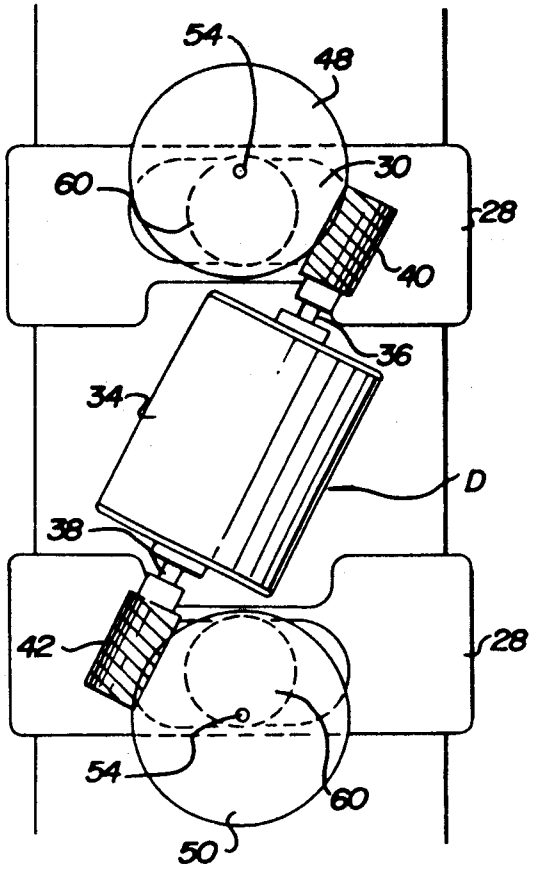
FIGS. 3 and 4 are plan views from above of the interior mechanism of the kneader showing the motor and gear mechanisms and the extended and contracted positions of the slide bars respectively.

As best shown in FIGS. 1 and 2, a massage device M is shown having a hollow container casing 10 formed of a hollow upper portion 12 having a lower opening 14. Casing 10 is contoured to be held comfortably in a user's hand. Upper portion 12 is shaped so that a user's palm may rest thereagainst and exert a required amount of pressure during massage.

A switch 16 is located on upper portion 12. Switch 16 is preferably a variable speed selector which allows adjustment of the intensity of the kneading action of the massage device M.

Figure 11:
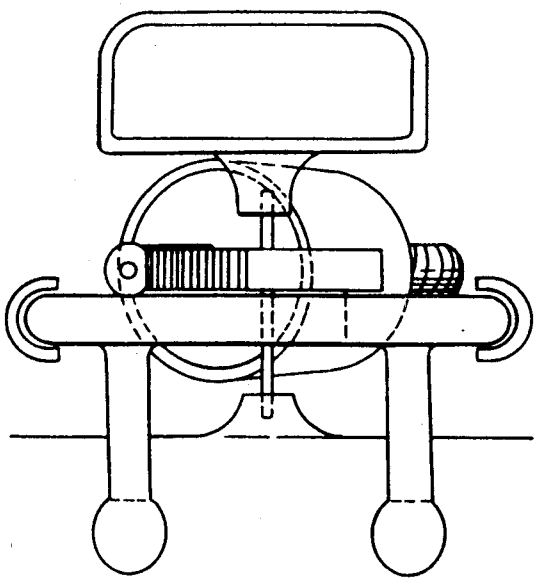
FIG. 11 is an end view of the kneader mechanism.
Figure 12:
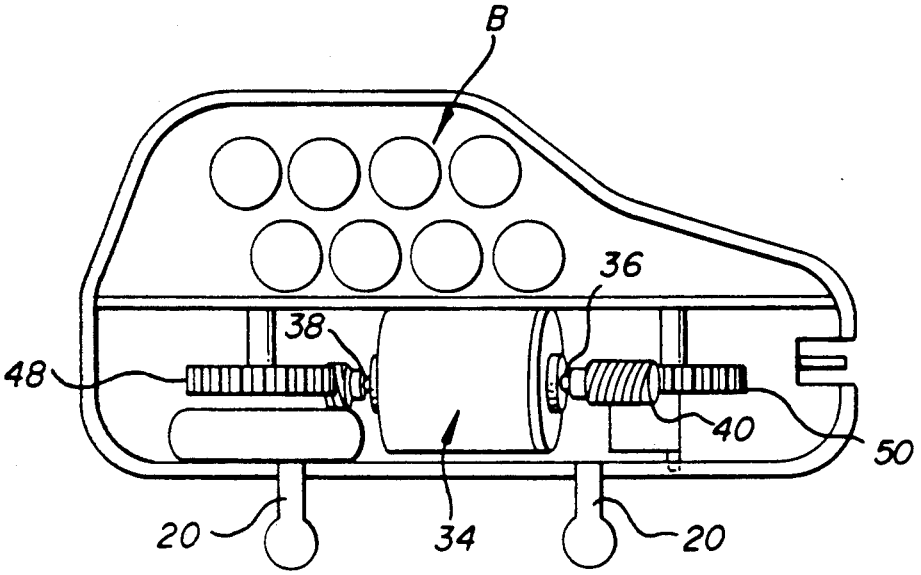
FIG. 12 is a side view of the mechanism, the casing being removed to show the interior.

A removable access door 18 is also located on upper portion 12 to permit access to a rechargeable battery pack B, as shown in FIG. 11, located within casing 10.

Figure 10:
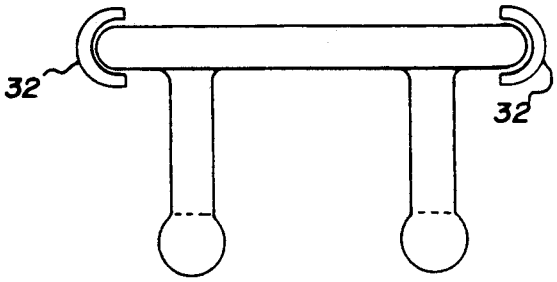
FIG. 10 is a side elevational view of the slide bar showing the massaging fingers extending downwardly therefrom and a pair of guide grooves.

Preferably, four fingers 20 extend outwardly from lower opening 14 of casing 10. Fingers 20 include pads 22 mounted thereon which are made of soft rubbery material and upon the application of gentle pressure, optimum contact with the skin can occur which enhances the kneading action. The pads 22 have embossed stippling 24 at their bottom which inhibits slipping when pads 22 are in contact with the skin. Pads 22 are mounted on spherical ends or massagers 26 of fingers 20 as best shown in FIG. 10.

FIGS. 3 to 8 show how the internal drive mechanism D causes reciprocating movement of each slide bar 28 of a pair of elongated slide bars 28 having a slot 30 formed therein and being slidably retained to casing 10 by grooves 32. Preferably, a pair of the fingers 20 are integrally attached to each slide bar 28 as best shown in FIG. 10.

Internal drive mechanism D includes a motor 34 which is electrically powered by preferably, the battery pack B or other electric power supply (not shown). Motor 34 is mounted horizontally, and has twin shafts 36 and 38 extending horizontally therefrom and are simultaneously rotatable by motor 34. Each of shafts 36 and 38 have a worm 40 and 42 mounted thereon, respectively. It is important that worms 40 and 42 each have threads 44 and 46 thereon, respectively. Preferably, threads 44 and 46 are opposite, that is to say that, if thread 44 is a right hand thread, then thread 46 is a left hand thread so that axial load exerted on the motor 34 is balanced during rotation, although the threads may be threaded in the same direction. Worms 40 and 42, provide the required speed reduction from the motor 34 to the worm gears 48 and 50 so that the worm gears 48 and 50 rotate in opposite directions at the same speed. Helical gears may be used instead of worm gears. Worm gears or helical gears must be threaded to match the threads of the worms, i.e. a right hand thread and a left hand thread where the worms have right and left hand threads.

Figure 7:
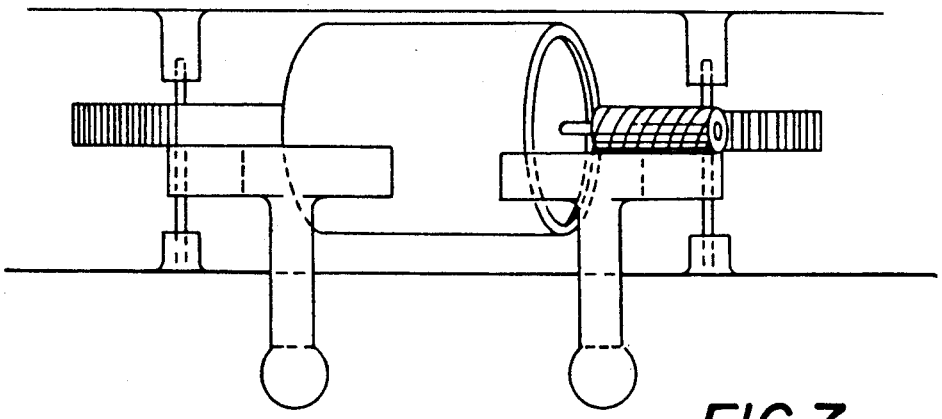
FIGS. 7 and 8 are elevational views of the interior gear mechanism in the contracted and extended positions, respectively.
Figure 8:
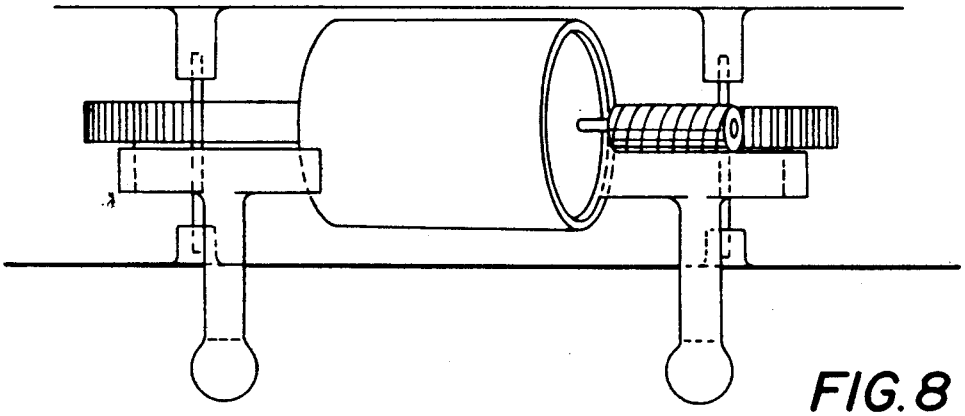
Figure 9:
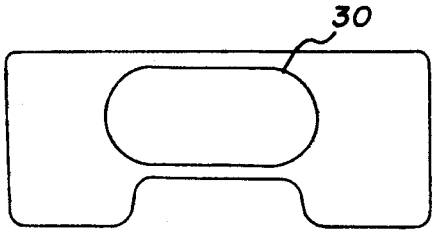
FIG. 9 is a top plan view of a slide bar showing the slide bar slots.

As best shown in FIGS. 7, 8 and 11, thread 44 of worm 40 engages the teeth 52 of worm gear 48 to transfer the rotational motion of worm 40, through a 90 degree translation resulting in the horizontal rotational motion of worm gear 48 around one of the vertical pins 54. Each pin 54 is held in place by a pair of vertically spaced upper and lower hubs 56, which surround each end of each pin 54. Casing 10 extends beneath each of slide bars 28 to support hubs 56.

A depending linking rod 60 is fixedly attached to worm gear 48 and spaced from pin 54 so that the outside edge of the linking rod 60 coincides with the outside edge of pin 54 and rotates with secondary gear 48 in a circular motion. Depending linking rod 60 extends into slot 30 and reciprocates throughout the length of slot 30 as gear 48 rotates about pin 54. The rotation of depending linking rod 60 causes one of the slide bars 28 to reciprocate back and forth in the guide grooves 32.

As shown in FIG. 10, outer edges 64 of slide bar 28 are rounded to conform with the shape of guide grooves 32 which restricts side-to-side movement of the slide bar 28. Guide grooves 32 are formed as a unitary part of the outer casing 10 within which the drive mechanism D is mounted. In an alternative arrangement (not shown), the slide bars 28 may be held in place by rods inserted through parallel holes in the slide bars. In this alternative arrangement, the rods are fitted into hubs which form a part of the molding of the outer casing 10.

Teeth 52 of worm 42 engage worm gear 50 to operate the other of slide bars 28 simultaneously in the same manner as described above.

Each slide bar 28 includes a recessed edge 66 to allow maximum reciprocating movement of each slide bar 28 relative to motor 34, while keeping the overall length of the massage device M to a minimum.

Figure 3:
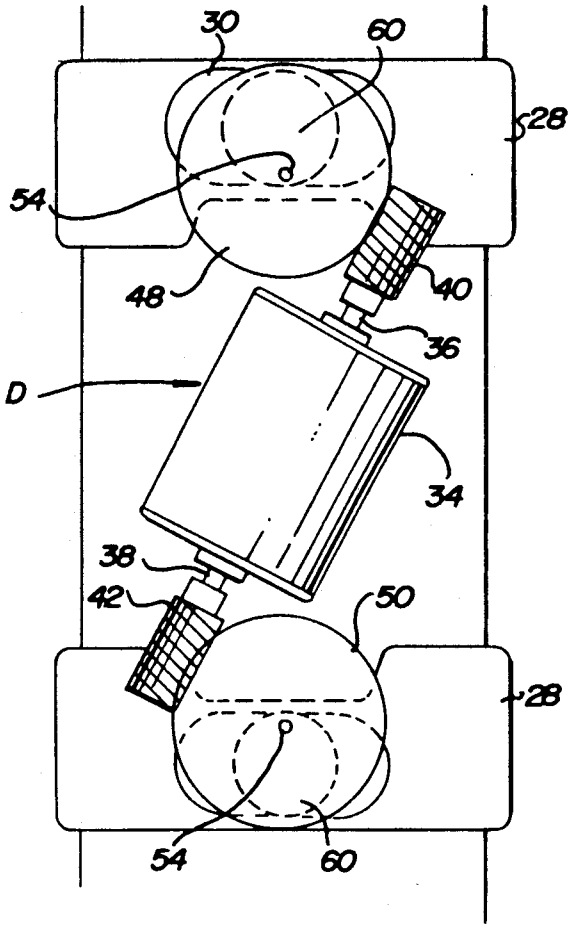

Each of the pairs of FIGS. 3 and 4, 5 and 6, and 7 and 8, show the ends of the reciprocating path of travel of the pair of slide bars 28. In FIG. 3, the slide bars 28 are in the open position of the cycle. As the worms 40 and 42 rotate, worm gears 48 and 50 are caused to rotate, respectively, by the meshing of threads 44 and 46 with the teeth 52 on the worm gears 48 and 50. The depending rod 60 on each of secondary gears 48 and 50 rotates around pin 54 and engages the outer portion of slide bar slot 30. While worm gears 48 and 50 rotate around fixed pin 54 relative to casing 10, depending rod 60 causes each slide bar 28 to move in a reciprocating motion towards and away from motor 34.

Figure 6:
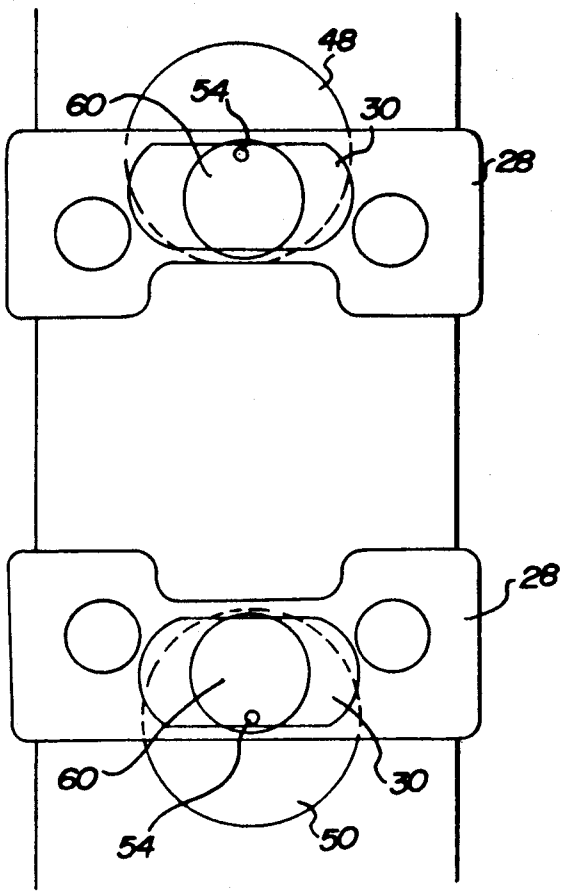
FIGS. 5 and 6 are plan views from below, showing the slide bars in the extended and contracted positions, respectively.
Figure 5:
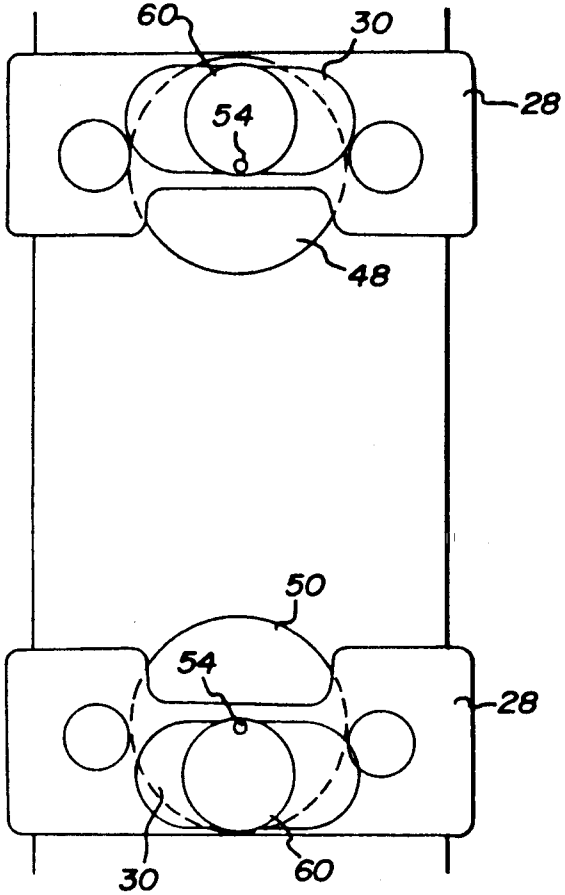

As best shown in the FIGS. 5 and 6, pairs of fingers 20 move towards and away from each other as worm gears 48 and 50 rotate, which causes the kneading action of the massage device M.

Recharging of the battery pack B without removal from the massaging device M is made possible by an electrical connection to a charging jack 68 located on the upper portion 12 of casing 10 as best shown in FIG. 2. Motor 34 may also be powered by a plug-in adaptor (not shown) for prolonged use over an extended period of time.

Switch 16 may be either an electronic or mechanical variety. In each case, the wiring (not shown for simplicity) is preferably designed to minimize power consumption in the switch 16. The electronic switch 16 controls motor speed by altering the length of time the pulsating current acts on the motor 34. In the case of a mechanical switch, the speed variation is achieved by bringing more batteries into the circuit, rather than by use of a rheostat which is inefficient with respect to power usage.

While this invention has been described as having a preferred embodiment, it is to be understood that the invention is capable of further modifications, uses, and/or adaptations which follow in general the principle of the invention and includes such departures from the present disclosure as come within known or customary practice in the art to which the invention pertains, and as may be applied to the central features hereinbefore set forth, and fall within the scope of the limits of the appended claims.

What we claim is:

1. A massage device comprising:

(a) casing means having a top and a bottom, and an inner chamber and an opening in the bottom to said inner chamber;

(b) said chamber including inner walls;

(c) motor means positioned in said chamber;

(d) said motor means having a front and a rear and having front drive means extending from said front and rear drive means extending from said rear;

(e) said chamber including guide means extending along at least one of said inner walls of said casing means;

(f) at least one pair of massaging means mounted on said guide means and extending outwardly from said opening;

(g) said at least one pair of massaging means including a first massager and a second massager;

(h) said first massager is connected to said front drive means and said second massager is connected to said rear drive means;

(i) each of said first massager and said second massager having a longitudinal axis;

(j) said motor means having a longitudinal axis;

(k) said front drive means and said rear drive means extending along said longitudinal axis of said motor means;

(l) said longitudinal axis of said motor means is perpendicular to said longitudinal axis of each of said first massager and said second massager;

(m) whereby, when said motor means is operated, said at least one pair of massaging means moves in a reciprocating motion relative to said motor means.

2. The massage device of claim 1, wherein:

(a) said front drive means includes a threaded worm;

(b) said rear drive means includes a threaded worm; and, (c) said worm gears are threaded in the same direction.

3. The massage device of claim 1, wherein:

(a) said front drive means includes a threaded worm;

(b) said rear drive means includes a threaded worm; and, (c) said worms are threaded in opposite directions.

4. The massage device of claim 1, wherein:

(a) said motor means is located between said at least one pair of massaging means.

5. The massage device of claim 1, wherein:

(a) said casing has a longitudinal axis extending in the same direction as said guide means; and, (b) said longitudinal axis of said motor means is angled relative to said longitudinal axis of said casing means.

6. A massage device comprising:

(a) casing means having a top and a bottom, an inner chamber and an opening in the bottom to said inner chamber;

(b) said chamber including inner walls;

(c) motor means positioned in said chamber;

(d) said chamber including guide means extending at least along one of said inner walls of said casing means;

(e) at least one pair of massaging means mounted on said guide means and extending outwardly from said opening;

(f) means for mounting each of said massaging means for reciprocal movement with respect to each other and said guide means;

(g) drive means associated with said motor means and connected to said pair of massaging means for reciprocally driving each of said massaging means relative to said guide means, and to each other;

(h) said drive means associated with said motor means and driven by said motor means for reciprocally driving each of said massaging means;

(i) said drive means include first gear means, second gear means, and linking means;

(j) said first gear means is rotatable about a first axis by said motor means and engages said second gear means;

(k) said second gear means is rotatable by said first gear means about a second axis;

(l) said linking means is connected to said second gear means and spaced from said second axis for rotational movement about said second axis;

(m) said linking means engages said massaging means for transferring rotational movement from said second gear means to said massaging means; and (n) said massaging means has located therein slot means for converting the rotational movement of said linking means to linear reciprocating movement of said massaging means.

7. The massage device as defined in claim 6, wherein:

(a) said first gear means rotates about a first axis;

(b) said second gear means rotates about a second axis; and, (c) said first axis of rotation is perpendicular to said second axis of rotation.

8. The massage device as defined in claim 7, wherein:

(a) said first gear means is a worm gear; and (b) said second gear means is a circular disk having a toothed perimeter.

9. The massage device of claim 8, wherein:

(a) said linking means forms a depending rod means and is rigidly affixed to said second gear means for rotational movement about said second axis.

10. The massage device of claim 6, wherein:

(a) said motor means includes a front and a rear and has a front drive means extending from said front and rear drive means extending from said rear;

(b) said at least one pair of said massaging means including a first massager and a second massager; and, (c) said first massager is connected to said front drive means and said second massager is connected to said rear drive means.

11. The massage device of claim 10, wherein:

(a) each of said first massager and said second massager have a longitudinal axis;

(b) said motor means has a longitudinal axis;

(c) said front drive means and said rear drive means extend along said longitudinal axis of said motor means; and, (d) said longitudinal axis of said motor means is perpendicular to said longitudinal axis of each of said first massager and said second massager.

12. The massage device as defined in claim 8 wherein said second gear is a worm gear.

13. The massage device as defined in claim 8 wherein said second gear is a helical gear.

* * * * *